US007161461B1

(12) United States Patent
Nelson

(10) Patent No.: US 7,161,461 B1
(45) Date of Patent: Jan. 9, 2007

(54) INJECTION MOLDED TRIM RESISTOR ASSEMBLY

(75) Inventor: Charles Scott Nelson, Fenton, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/369,399

(22) Filed: Mar. 7, 2006

(51) Int. Cl.
*H01C 10/00* (2006.01)

(52) U.S. Cl. ..... 338/195; 338/226

(58) Field of Classification Search ..... 338/195, 338/199, 226, 232, 273, 275, 276; 29/612–613, 29/62
See application file for complete search history.

(56) References Cited

U.S. PATENT DOCUMENTS 3,469,226 A * 9/1969 Solow ..... 338/195
3,512,254 A 5/1970 Jenkins
3,742,422 A * 6/1973 Rozema et al. ..... 338/276
3,768,157 A 10/1973 Buie
4,134,095 A * 1/1979 Reddy ..... 338/25
4,176,445 A 12/1979 Solow
4,298,855 A 11/1981 Mills
4,479,107 A 10/1984 Bleeke
4,481,497 A 11/1984 Kurtz et al.
4,792,779 A 12/1988 Pond et al.
4,924,067 A 5/1990 Wilhelmson
5,081,439 A 1/1992 Natzle et al.
5,591,364 A 1/1997 Suppelsa et al.
6,188,307 B1 2/2001 Katsuki et al.
6,208,233 B1 3/2001 Stein, Sr. et al.

* cited by examiner

*Primary Examiner*—Tu Hoang
(74) *Attorney, Agent, or Firm*—Paul L. Marshall

(57) ABSTRACT

A trim resistor assembly includes a trimmable resistor element embedded within a polymeric housing. The trimmable resistor element includes trimmable resistive film disposed on a nonconductive substrate. Lead wires are connected to contact pads on the substrate. The resistor element and wires are pre-assembled and placed within a mold defining a cavity. The mold includes a pedestal that covers a central region of the substrate that includes the trimmable resistive film. A polymeric material is injected into the cavity to form an integrally molded body that is the polymeric housing. In addition to the trim resistor element and the bare end sections of the wires, the section of the wires that are adjacent the end sections and include the polymeric sheath are also embedded in the housing to strengthen and seal the joint. The pedestal forms an opening in the housing that exposes the resistive film to provide access for trimming the resistance to a desired value. By embedding the trimmable resistor element and the electrical connections within an integral body, the dimensions of the housing may be minimized, and damage to the electrical connections is reduced.

9 Claims, 2 Drawing Sheets

INJECTION MOLDED TRIM RESISTOR ASSEMBLY

TECHNICAL FIELD OF INVENTION

This invention relates to a trim resistor assembly, and more particularly, to a trim resistor assembly comprising a trimmable resistive film disposed on a nonconductive substrate and encapsulated within an injection molded polymeric housing having an opening for access to the resistive film for purposes of trimming the resistance.

BACKGROUND OF INVENTION

PCT Patent Application Publication WO 02/075754 describes a resistor assembly comprising a trim resistor element enclosed within a two-piece housing. The trim resistor element includes an electrically resistive film disposed on a substrate and is received in a recess in a polymeric housing body. A housing top is bonded to the housing body to enclose the trim resistor and has an opening exposing the resistive film. Wires extend through the housing for electrical connection with the film. Following assembly, a laser beam is directed through the opening to remove a portion of the resistive film to adjust the resistance to a desired value. Following trimming, the opening is preferably sealed with a polymeric material. The product assembly is suited for use as a component in an automotive electrical system and may be inserted within a sheath of a wiring harness.

The two-piece housing requires two molding operations, with associated tooling, and a bonding operation that significantly contribute to the cost of the assembly. Also, care is needed in assembling and covering the trim resistor element within the recess to avoid damage to the electrical connection. Further, the lateral dimensions of the housing need to be sized to allow a suitable bond to be formed between the polymeric body and top without damage to the trim resistor element, which may add to the overall size of the trim resistor element and complicate insertion into the wiring harness. Still further, clearance between the trim resistor element and the housing may allow the trim resistor element to vibrate within recess during use and may lead to damage to the electrical connections.

Thus, there is a need for a trim resistor assembly that encapsulates the trim resistor element within a polymeric housing without a bonding operation and eliminates clearances about the trim resistor element within the recess of the housing, while nevertheless allows access to the resistive film for purposes of trimming the resistance.

SUMMARY OF THE INVENTION

In accordance with a preferred embodiment of this invention, a trim resistor assembly comprises a trimmable resistor element embedded within a polymeric housing. The trimmable resistor element includes a nonconductive substrate. A resistive film is disposed on the substrate and includes a trimmable end portion. Also disposed on the substrate are first contact pad and a second contact pad in spaced relationship and in electrical communication with the resistive film. A first lead wire, which includes a metal wire encased within a polymeric sheath, has an end section that is stripped of the sheath and in contact with the first contact pad. Similarly, a second lead wire is provided having an end section formed of the metal wire stripped of the polymeric sheath and in contact with the second contact pad. The polymeric housing is formed of an integrally molded body in which the trim resistor element and the end sections of the wires are embedded. Preferably, sections of the wires that are adjacent to the end sections are also embedded in the housing to strengthen and seal the joint. The polymeric body defines a trim opening exposing said resistive film to provide access for trimming the resistive film to a desired resistance. By embedding the trimmable resistor element and the electrical connections within an integral body, the dimensions of the housing may be minimized to facilitate incorporation within a wiring harness or the like, and damage to the electrical connections is reduced.

In accordance with another aspect of this invention, a method is provided for manufacturing a trim resistor assembly. A trimmable resistor element is provided that includes the nonconductive substrate, the resistive film, the first contact pad and the second contact pad. The substrate includes an obverse face having a central region and a perimeter region and a reverse face opposite the obverse face. A first lead wire is connected to the first contact pad, and a second lead wire is connected to the second pad. This forms a pre-assembly that comprises the trimmable resistor element and the first and second wires. The pre-assembly is arranged within a mold that defines a cavity. The mold includes a pedestal that covers the central region while exposing the perimeter region within the cavity. A polymeric material is injected into the cavity to form the polymeric housing. Within the cavity, the polymeric material is molded against the perimeter region of the obverse face and the reverse face of the substrate, thereby embedding the trimmable resistive element within the housing. The resulting assembly is removed from the mold. As the pedestal is withdrawn from the housing, an opening is formed and exposes the central region of the substrate, for purposes of trimming the resistance of the resistive film. By forming the housing in a single injection molding operation, a robust product assembly is formed at a reduced coast.

BRIEF DESCRIPTION OF DRAWINGS

This invention will be further described with reference to the accompanying drawings in which.

DETAILED DESCRIPTION OF INVENTION

In accordance with a preferred embodiment of this invention, referring to FIGS. 1 through 4, a trim resistor assembly comprises a trimmable resistor element 12 encased within a polymeric housing 14 and connected to insulated electrical wires 16, 18 and 20.

Figure 1:
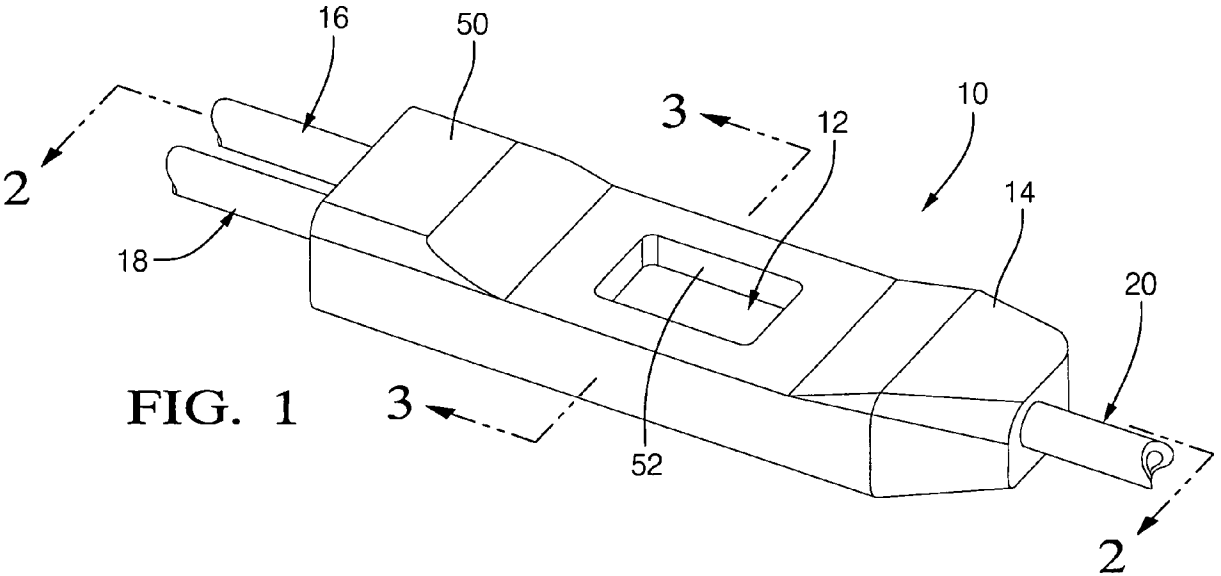
FIG. 1 is a perspective view of a trim resistor assembly in accordance with a preferred embodiment of this invention.
Figure 2:
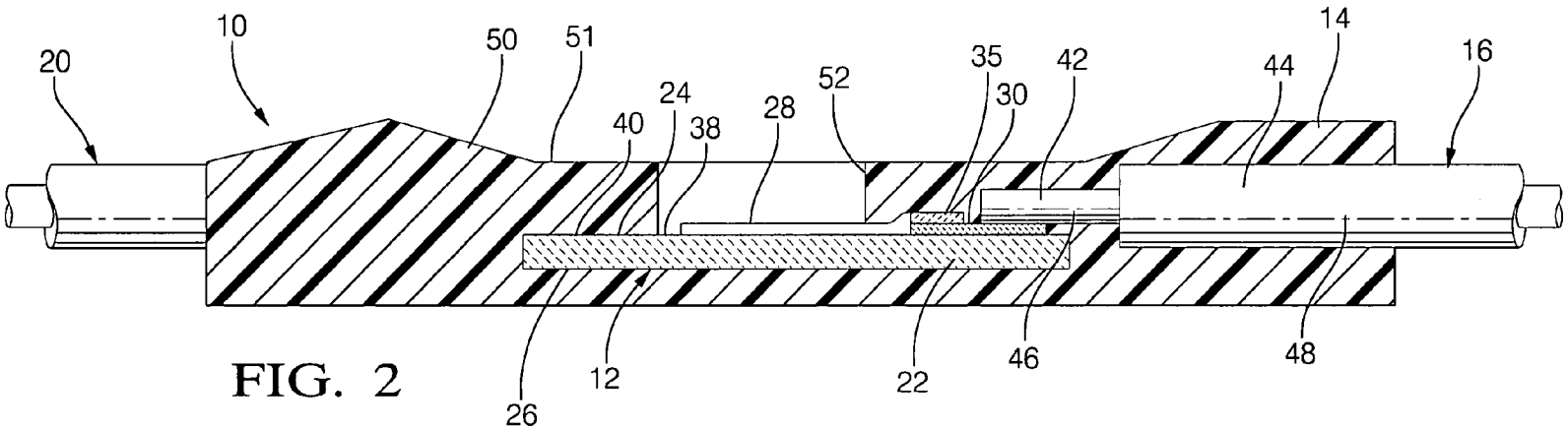
FIG. 2 is a cross-sectional view of the trim resistor assembly in FIG. 1, taken along lines 2—2 in the direction of the arrows.
Figure 3:
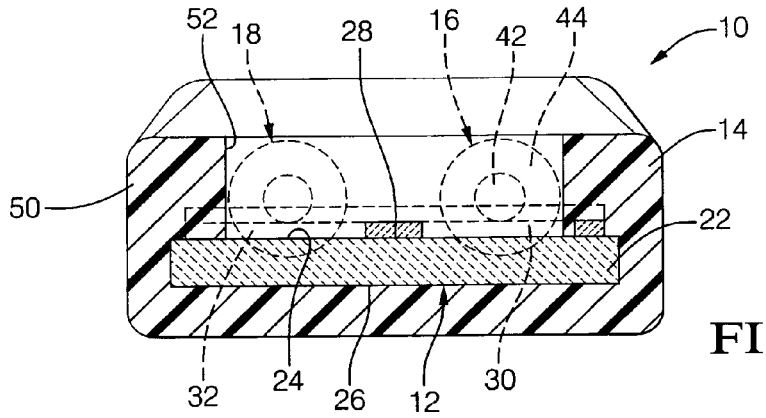
FIG. 3 is a cross-sectional view of the trim resistor assembly in FIG. 1, taken along lines 3—3 in the direction of the arrows.
Figure 4:
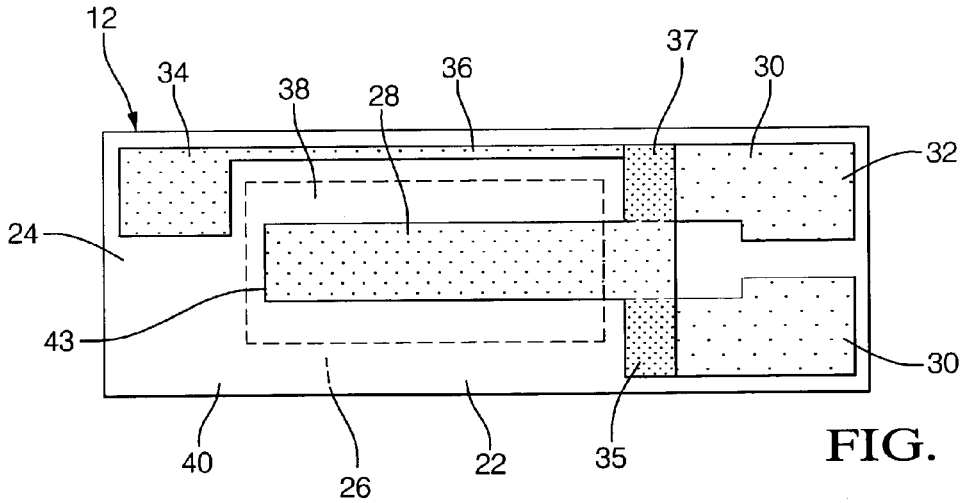
FIG. 4 is a plan view of the trim resistor element in the trim resistor assembly in FIG. 1.

Trimmable resistor element 12 comprises a substrate 22 having an obverse face 24 and a reverse face 26. Substrate 22 is formed of a nonconductive material that is preferably able to withstand the resistance trimming operations. A preferred material is alumina, although other ceramic or polymeric materials may be suitable. Referring particularly to FIG. 4, a resistive film 28 is disposed onto face 24 and is formed of an electrical resistive material. A preferred composition comprises ruthenium oxide particles and is readily applied as an ink comprising a volatile solvent. Also disposed on surface 24 are contact pads 30, 32 and 34 in electrical communication with film 28. Pads 30, 32 and 34 are formed of film of an electrically conductive material. A preferred composition comprises palladium particles and is readily applied as an ink containing a volatile solvent. At regions 35 and 37, the conductive film overlies the resistive film, thereby providing the desired electrical communication between the pads and the film. In this embodiment, pads 30 and 32 are located in parallel arrangement adjacent one end of the substrate for connection to wires 16 and 18, whereas pad 34 is located adjacent the opposite end of the substrate and is connected to pad 32 by lead 36. This arrangement provides suitable sites for connection to wires 16 and 18 that extend in parallel in a first direction from the housing, and provides pad 34 to allow connection to wire 20 that extends in a direction opposite wires 16 and 18. Thus, when inserted longitudinally into a sheath of a wiring harness, the arrangement is conducive to wire connections in opposite directions. It is significant that face 24 includes a central region 38 surrounded by a perimeter region 40, and that central region 38 includes end 43 of film 28. During manufacture, film 28 is trimmed to adjust the electrical resistance measured between pads 30 and 32, to obtain a desired resistance value for a particular application.

To provide the necessary electrical connection, wire 16 is bonded to pad 30. Wire 16 comprises a metal wire 42, preferably formed of multiple metal strands, enclosed within a polymeric sheath 44. The sheath is stripped from an end section 46 to expose the metal wire to allow electrical as well as physical contact to the pad. Preferably, wire 42 is soldered to the pad. Alternately, the connection may be formed by tack welding or other suitable process. While in the described embodiment the wire end section is directly attached to the pad, a suitable connection may be formed without direct attachment, for example, by crimping a terminal element onto the wire and bonding the pad to the terminal element. Wire 16 also includes an adjacent section 48 adjacent to end section 46. In the preferred embodiment, adjacent section 48 includes the polymeric sheath and is encased within housing 14 to strengthen the joint between the housing and the wire. Also, for a multiple strand wire, bonding the adjacent section to the housing forms a hermetic seal to prevent air passage through the gaps between the strands and thereby protect the electrical connections from corrosion. Also, while in general sheath 44 may be formed of any suitable electrically insulative polymeric material, in an automotive system where the lead wire extends to a high temperature environment, it is desirable to employ a sheath is formed of a polytetrafluoroethylene compound. In such instance, it is preferred to etch the adjacent section to improve adhesion to the polymeric material of the housing. Wires 18 and 20 are similar to wire 16 and include end sections that are stripped of the polymeric sheath and expose metal wire that is connected to pads 32 and 34, respectively, and adjacent sections that are embedded within the polymeric body forming housing 14.

Resistor element 12 and the end and adjacent sections of wires 16, 18 and 20 are embedded within an integrally molded polymeric body 50, which forms housing 14. Housing 14 includes a top surface 51 and an opening 52 that exposes central region 38 of substrate 22. In this manner, film 51 is spaced apart from the top surface, and end 43 of film 28 is exposed to allow access for purposes of trimming the length and adjusting the resistance. It is significant that polymeric body 50 is formed against the perimeter region of face 24 and also against rear face 26 and extends continuously about the sides of substrate 22. This secures the resistor element 12 within the polymeric body without any clearance that would allow the substrate to vibrate within the housing. Also, the end sections of the wires are embedded within the polymeric body to protect the connections to the conductive pads. In addition, the adjacent sections of the wires are firmly embedded within the polymeric body seal the housing and to prevent the wires from becoming pulled away from the housing, which might otherwise damage the connections to the pads.

In the preferred embodiment, following the trimming of the resistance, a polymeric seal is applied to fill opening 52 and thereby protect film 28 from corrosion or other environmental damage.

The manufacture of trim resistor assembly is now described. A film formed of electrically conductive material is applied to the substrate and patterned to form pads 30, 32 and 34 and lead 36. A preferred conductive film is composed of palladium ink and is printed onto selected regions of the substrate and fired. A second film of electrically resistive material is then applied to substrate 22, including onto regions 35 and 37 of resistive film 28, and patterned to form film 28. Preferably, film 28 is formed of a ruthenium oxide ink, which is printed and fired at a temperature less than the firing temperature of the palladium film. Substrate 22, resistive film 28 and pads 30, 32 and 34 thus form trimmable resistive element 12.

Figure 5:
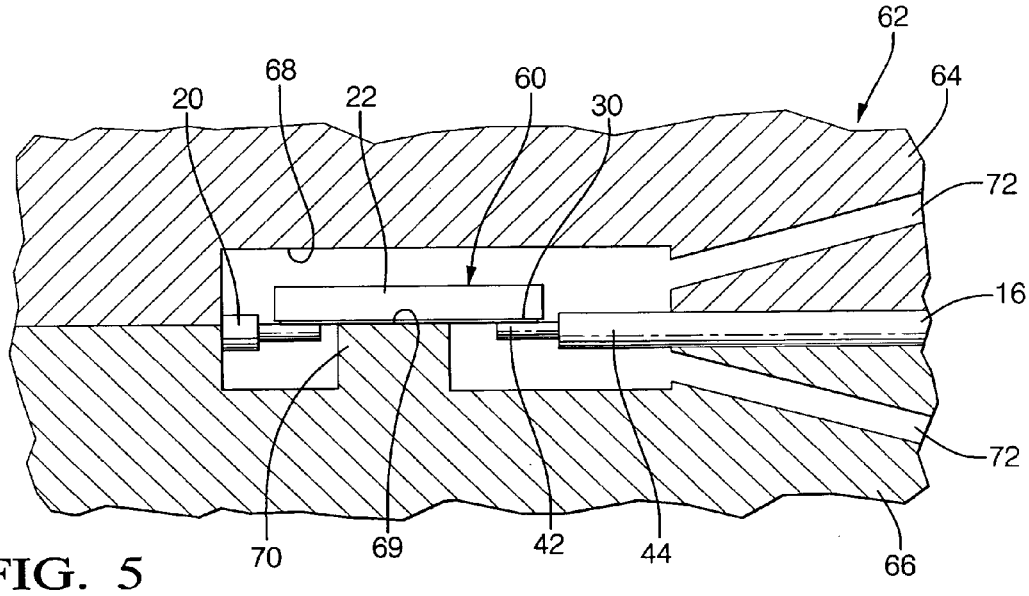
FIG. 5 is a cross-section view of a mold for manufacturing the trim resistor assembly in FIG. 1.

Wires 16, 18 and 20 are stripped to expose the metal wire at the end sections. The end sections are arranged in contact with pads 30, 32 and 34, respectively, and bonded to the pads to form the desired electrical connections. In a preferred embodiment, the wires are soldered to the pads. Soldering provides a durable physical joint as well as electrical communication. In a preferred embodiment using wire that includes a polytetrafluoroethylene sheath, the adjacent section of the wire is etched prior to attaching the wire to the substrate. Etching promotes adhesion to the polymeric material during the subsequent molding operation. Following attachment of the wires, a pre-assembly 60 is formed, as shown in FIG. 5.

Pre-assembly 60 is arranged within a mold 62 comprising sections 64 and 66 that define a cavity 68 corresponding to the shape of housing 14. Mold section 66 includes a pedestal 70 for supporting the resistor element within cavity 68. Pedestal 70 includes an mask face 69 upon which the substrate rests and having a size and shape corresponding to the desired central region 38. In this manner, pedestal 70 masks the central region to prevent polymeric material from being molded against the region and so covering the region. Also, pedestal 70 forms opening 52 in the housing to provide access to the central region for subsequent trimming operations. Following arrangement of the pre-assembly on pedestal 70, mold sections 64 and 66 are closed, and polymeric material is injected into cavity 68. In a preferred embodiment, a melt of a thermoplastic polymeric material is injected, and coolant is circulated through passages (not shown) in the mold sections to cool and solidify the polymeric material to form body 50. Alternatively, a precursor composition may be injected and cured to form a thermoset polymeric body.

Following injection molding, sections 64 and 66 are opened and trim resistor assembly 10 is removed from the mold. As the assembly is removed, pedestal 70 is withdrawn from the molded body to form opening 52 and expose central region 38 of resistor element 12. Wires 16 and 18 are connected to a suitable ohmmeter, and the resistance measured therebetween. The resistance depends upon the size of film 28 and is suitably adjusted by removing material. In a preferred embodiment, a laser beam is directed through opening 52 to ablate film material until a desired resistance is obtained, as measured between the wires. Following trimming of the resistive film, a polymeric material is preferably applied to seal opening 52 and form the finished product, thereby protecting film 28 from corrosion or other damage that might adversely affect the desired resistance.

The product trim resistor element is particularly well suited for use in an automotive wiring system. Because the housing is formed of an integrally molded body, the dimensions may be minimized while providing sufficient strength, particularly along the sides between the upper and lower portions, to securely and hermetically seal the trim resistor element within the housing. When installed as part of a wiring harness, it is common practice to enclose the wiring harness within a protective sheath. The minimal dimensions facilitate insertion of the resistor assembly into the end of the sheath. Because the housing is injected molded against the resistor element, no clearance is provided to allow the substrate to vibrate. Also, the wires are embedded in the housing, and the contacts between the wires and the conductive pads are sealed by the housing. This also prevents damage to the contacts. Furthermore, by forming the housing in a single molding operation, the expense of multiple molding operations and bonding steps is eliminated.

While this invention has been described in terms of the preferred embodiments thereof, it is not intended to be so limited, but rather only to the extent set forth in the claims that follow.

We claim:

1. A method for manufacturing a trim resistor assembly comprising providing a trimmable resistor element comprising a nonconductive substrate, a resistive film disposed on the surface and including a trimmable portion, a first contact pad disposed on the substrate in contact with said resistive film, and a second contact pad disposed on the substrate spaced apart from the first conductive pad and in contact with the resistive film, said substrate comprising an obverse face having a central region and a perimeter region and a reverse face opposite the obverse face;

connecting a first lead wire to the first contact pad and a second lead wire to the second pad, thereby forming a pre-assembly;

arranging the pre-assembly within a mold, said mold defining a cavity and comprising a pedestal and said pre-assembly being arranged such that the pedestal covers the central region and said perimeter region is exposed within the mold;

injecting a polymeric material into the cavity to form a polymeric housing, said polymeric material being injected against the perimeter region of the obverse face and the reverse face of said trimmable resistive element to embed the trimmable resistive element within the polymeric housing, thereby producing an assembly; and removing the assembly from the mold, said removing including withdrawing the pedestal from the polymeric housing to form an opening in the polymeric housing and expose the central region of the substrate.

2. A method in accordance with claim 1, wherein the first lead wire comprises a metal wire and a polymeric sheath about the metal wire, said first lead wire including an end section stripped of the polymeric sheath and whereat the metal wire is exposed;

wherein the second lead wire comprises a metal wire and a polymeric sheath about the metal wire, said first lead wire including an end section stripped of the polymeric sheath and whereat the metal wire is exposed; and wherein the end section of the first lead wire is connected to the first conductive pad and the end section of the second lead wire is connected to the second conductive pad.

3. A method in accordance with claim 2, wherein the first wire comprises an adjacent section adjacent to the end section; and wherein the second wire comprises an adjacent section adjacent the end section, and wherein the step of injecting the polymeric material includes injecting the polymeric material into contact with the adjacent sections and the end sections of the first and second lead wires so as to embed adjacent sections and the connections between the end sections and the conductive pads within the housing.

4. A method in accordance with claim 1, wherein the mold defines a cavity, and wherein the polymeric material is injected into the cavity.

5. A method in accordance with claim 4, wherein mold comprises upper and lower sections, and wherein the pedestal extends from the lower section to support the substrate within the cavity.

6. A trim resistor assembly comprising:

a trimmable resistor element comprising a nonconductive substrate, a resistive film disposed on the substrate and including a trimmable end portion, a first contact pad disposed on the substrate in contact with said resistive film, and a second contact pad disposed on the substrate spaced apart from the first conductive pad and in contact with the resistive film;

a first lead wire comprising a metal wire and a polymeric sheath encasing the metal wire, said first lead wire having an first end section whereat the metal wire is exposed and is in contact with the first contact pad and an adjacent section that includes the polymeric sheath;

a second lead wire comprising a metal wire and a polymeric sheath encasing the metal wire, said second lead wire having a second end section whereat the metal wire is exposed and is in contact with the second contact pad and an adjacent section that includes the polymeric sheath; and a polymeric housing formed of an integrally molded body, said trimmable resistor element and said end sections and said adjacent sections of said first and second lead wires being embedded in the molded body, said polymeric housing having a top surface and defining a trim opening exposing said resistive film, whereby the resistive film is spaced apart from the top surface of the polymeric housing and the trim opening provides access for trimming the resistive film to a desired resistance.

7. A trim resistor assembly in accordance with claim 6, further comprising a polymeric seal within the trim opening.

8. A trim resistor assembly in accordance with claim 6 wherein the substrate comprises an obverse surface and a reverse surface, said obverse surface bearing the resistive film, the first contact pad and the second contact pad and having a perimeter region, and wherein the polymeric body is molded against the reverse surface and the perimeter region of the obverse surface to secure the trimmable resistor element within the polymeric housing.

9. A trim resistor assembly in accordance with claim 6 wherein the end sections of the first and second lead wires are parallel.

* * * * *